United States Patent [19]

Benoit et al.

[11] Patent Number: 4,672,755

[45] Date of Patent: Jun. 16, 1987

[54] UNLATCHING LEVER AND BOOT HAVING SUCH UNLATCHING LEVER

[75] Inventors: Louis Benoit, Frangy; Bernard Nerrinck, La Balme-de-Sillingy, both of France

[73] Assignee: Salomon S.A., Annecy, France

[21] Appl. No.: 736,088

[22] Filed: May 20, 1985

[30] Foreign Application Priority Data

May 18, 1984 [FR] France ..... 84 08599

[51] Int. Cl.[4] ..... A43B 5/04; A43B 11/00

[52] U.S. Cl. ..... 36/117; 36/50; 24/68 SK

[58] Field of Search ..... 36/117–121, 36/105, 50; 24/68 SK, 69 SK, 70 SK, 71 SK

[56] References Cited

U.S. PATENT DOCUMENTS

| | | | |
|---|---|---|---|
| 4,112,557 | 9/1978 | Salomon . | |
| 4,253,217 | 3/1981 | Marzocchi | 36/117 X |

FOREIGN PATENT DOCUMENTS

| | | | |
|---|---|---|---|
| 0053340 | 6/1982 | European Pat. Off. . | |
| 1685814 | 2/1974 | Fed. Rep. of Germany . | |
| 3236259 | 4/1983 | Fed. Rep. of Germany | 36/119 |
| 3342121 | 6/1984 | Fed. Rep. of Germany | 36/119 |
| 2432280 | 2/1980 | France | 36/50 |
| 2514621 | 4/1983 | France . | |
| 8220887 | 6/1984 | France . | |
| 2556189 | 6/1985 | France . | |
| 2559358 | 8/1985 | France . | |
| 549970 | 6/1974 | Switzerland | 36/105 |
| 3342331 | 5/1984 | United Kingdom | 36/50 |

*Primary Examiner*—James Kee Chi

*Attorney, Agent, or Firm*—Sandler & Greenblum

[57] ABSTRACT

Latching apparatus and unlatching means for use with a ski boot of the type having a shell base and an upper. The upper is adapted to open to allow for entry of the foot into said ski boot. The latching apparatus has at least two positions, an open position in which the upper is left to open to allow for entry of the foot, and a closed position in which the upper is closed around the lower portion of the leg. The latching apparatus is associated with the unlatching means whereby the unlatching means allows for opening of the latching apparatus without the skier having to bend down.

52 Claims, 12 Drawing Figures

UNLATCHING LEVER AND BOOT HAVING SUCH UNLATCHING LEVER

BACKGROUND OF THE INVENTION

1. Field of the Invention

The present invention relates to rear entry ski boots which comprise a latch closure mechanism for closing the upper around the lower leg of the skier, and relates more particularly to a lever which makes it possible to more easily open the latch at will.

2. Description of Relevant Materials and Background

In a known manner, rear entry ski boots comprise a rigid shell base on which is journalled at least in part, around a horizontal transverse axis, an upper which is composed of a cuff and a rear spoiler. The rear spoiler is itself journalled around a transverse horizontal axis which can be coincident with the axis of the cuff, attached to the upper and/or the rigid shell base in a manner so as to be able to pivot rearwardly to allow for the introduction of the foot into the boot with a frontward movement.

For insertion of the foot in the boot to be efficient for skiing, as well as comfortable, it is necessary to assure closure and latching of the upper on the lower leg of the skier by connection of the rear spoiler to the cuff.

To achieve this the cuff is provided on both sides with generally adjustable anchorage points. A hook and pin system may be provided for a cable which passes from one side to the other of the rear spoiler through guides, and can be stretched and pulled tight by means of a latching or manipulation lever journalled on the rear spoiler which latches or locks in the closed position. This lever is in the general configuration of a solid plate, flat or arched, and which occupies a relatively substantial portion of the width of the dorsal part of the rear spoiler. Instead of being solid, the lever can also be in the form of a "U" or horseshoe between the arms of which may be provided an adjustment element capable of assuring functions other than closure of the boot. Such a lever is described in French Application No. 84 029 900, the disclosure of which is hereby incorporated by reference thereto.

Furthermore, the same lever may be adapted, in addition to closure of the upper around the lower leg, to assure the tightening and hold down of the foot in the shell base by means of a single manipulation.

The latching action of the lever is obtained by an elbow or over the center toggle latch formed by guiding the cable through a direction change on the rear spoiler, over the journalled axis of the lever on the rear spoiler and the connection of the cable to the free end of the lever. By moving back the lever from the open position until the dead point, one obtains closure and then, after passing through the dead point, latching into the closed position.

When seeking maximum simplicity and ease in the manipulation of the closure and latching of the boot, it becomes desirable to eliminate all manual intervention of the skier as is shown for example in French Patent Application No. 83 20 413 which discloses apparatus having a closure and latching lever with a spring return, for example. Opening of the boot requires a voluntary intervention by the skier to unlatch the latch.

Likewise, in certain apparatus wherein closing and latching can be performed directly with the other foot without the skier having to bend down, a voluntary intervention of the skier is still necessary on the lever to cause unlatching. By virtue of the elbow apparatus, unlatching has always necessitated a "voluntary" intervention which can hardly be anything other than manual, to lift the lever above the dead point, which in effect requires that the skier must bend down to reach the free end of the lever.

SUMMARY OF THE INVENTION

It is, therefore, an object of the invention to provide a latching system for ski boots wherein the boot may be opened by the skier without having to bend down.

According to the invention, the above objective is achieved by means of the inventive latching apparatus and associated unlatching means for use with a ski boot. The ski boot is formed of a shell base and an upper. The upper is adapted to open in a manner so as to allow for entry of the foot. The latching apparatus has at least two positions, an open position in which the upper is left to open to allow for entry of the foot, and a closed position in which the upper is closed around the lower portion of the leg. The latching apparatus is associated with the unlatching means whereby the unlatching means allows for opening of the latching apparatus without the skier having to bend down.

The unlatching means may comprise an unlatching lever associated with the latching apparatus whereby force exerted on the unlatching lever causes the latching apparatus to move to the open position.

The latching apparatus comprises a cable and a latching lever. The latching lever is associated with the cable whereby closure of the latching lever draws the cable to close the upper. The latching lever has an open position, a dead point ahead of a closed position, and a closed position. The unlatching lever is adapted to exert a force on the latching lever to move the latching lever from the closed position and past the dead point towards the open position. The tension of the cable when the latching lever is in the closed position is sufficient to open the latching lever after it is moved through its dead point by the unlatching lever. The latching lever serves as an over-the-center toggle, and the unlatching lever is positioned to "break" the toggle to the open position upon the application of pressure onto the unlatching lever.

The ski boot may furthermore be of the type which includes a foot hold down for exerting pressure on the instep of the foot. The foot hold down is regulated by means of a second cable which may be distinct from or the same as the first cable. The second cable is operated by means of a hold down lever. The hold down lever is an over the center toggle having open, closed and dead point positions. The hold down lever and the latching lever are positioned to pivot in the same general direction upon application of force to the unlatching lever.

The unlatching lever and latching lever may in one embodiment both be pivotably mounted on the boot to pivot around a common axis. In this embodiment the unlatching lever acts as a mechanical lever having its longer lever arm exposed in a manner so that it can be kicked by the skier's other boot, thereby exerting a force on the latching lever to move the latching lever from the closed position past the dead point towards the open position.

According to another embodiment the unlatching lever is pivotably mounted on the boot along a pivot axis different from the pivot axis of the latching lever. The unlatching lever acts as a mechanical lever having longer and shorter lever arms, the longer lever arm being exposed in a manner so as to be kicked by the skier's other boot, thereby exerting a force through the shorter lever arm on the latching lever to move the latching lever past the dead point towards the open position.

The unlatching lever may be mounted between the latching lever and the boot whereby force exerted on the unlatching lever pushes the latching lever to pivot away from the boot towards the open position. In this embodiment the unlatching lever has an upper exposed portion, and an intermediate portion positioned to exert a force on the latching lever as the unlatching lever pivots.

The unlatching lever may be protected within an enclosure covered by a flexible membrane whereby the unlatching lever is effectively exposed to a force being exerted thereon through the membrane, but is nevertheless protected from the elements.

The latching lever may have a "U" configuration to allow for placement of an adjustment mechanism between the two arms of the "U".

Although described generally, it is intended that the latching apparatus be affixed to a boot.

BRIEF DESCRIPTION OF THE DRAWINGS

The invention will now be described with reference to the annexed drawings given by way of non-limiting example only in which.

DESCRIPTION OF PREFERRED EMBODIMENTS

It is an aim of the present invention to overcome the disadvantages of the prior art and the apparatus of the invention allows a skier, without bending down, to undo his boots by "breaking" the latching system, for example by simple action of the other foot, irrespective of whether the latching procedure is automatic or likewise foot-controlled.

Figure 1:
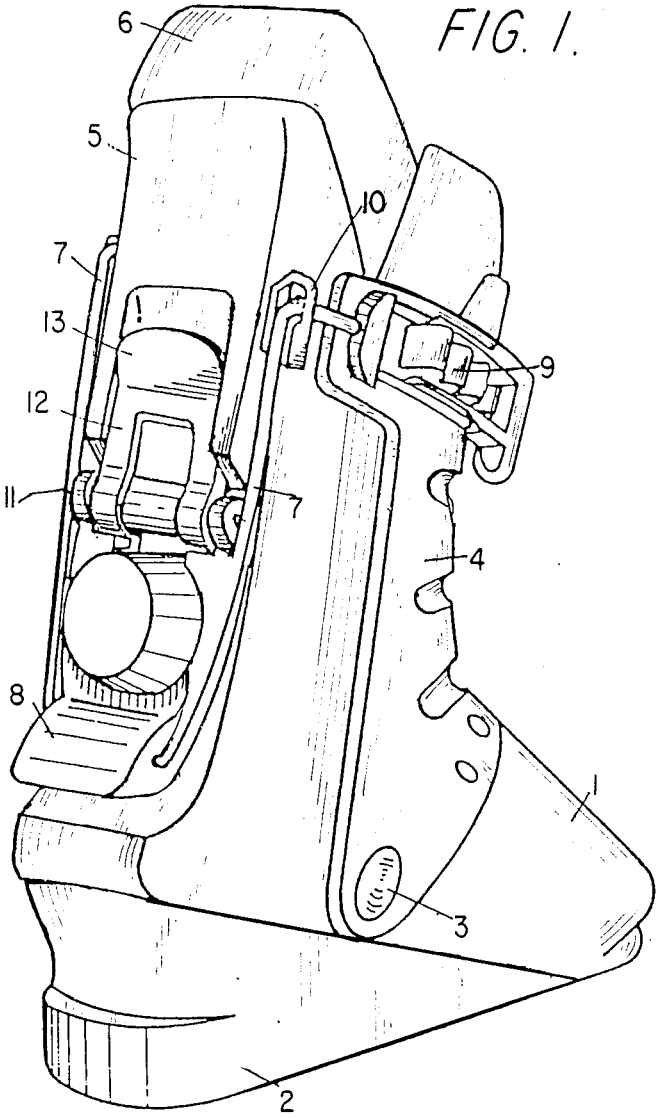
FIGS. 1, 2 and 3 respectively illustrate three embodiments of latching levers according to the invention, FIG. 3*a* illustrating in cross-section a detailed portion of FIG. 3.
Figure 2:
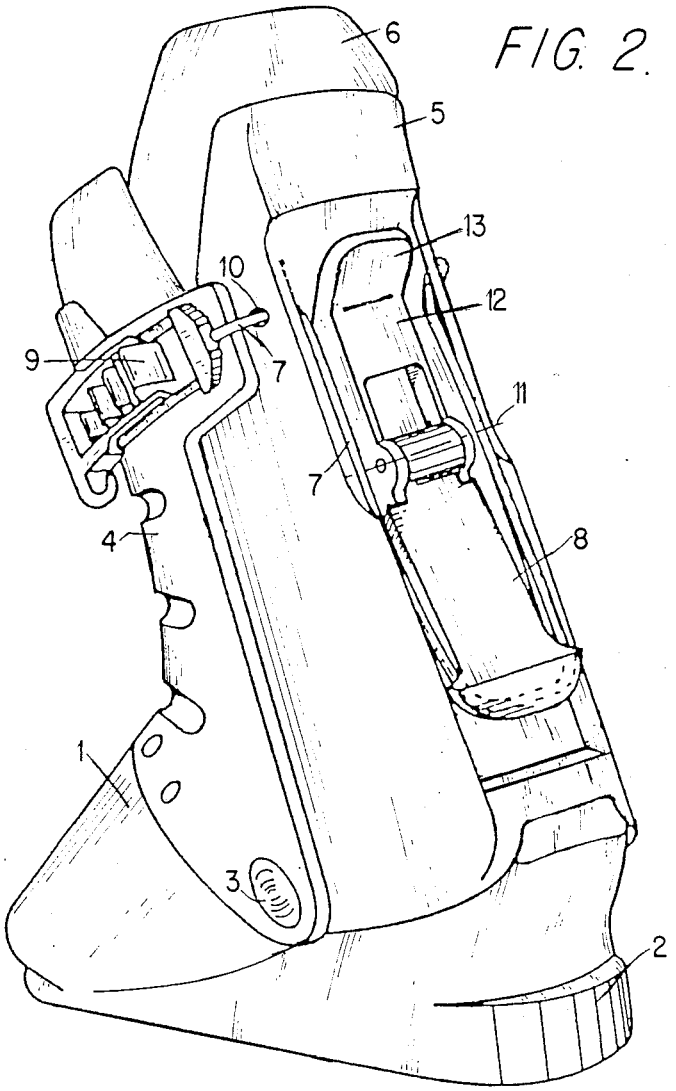
Figure 3A:
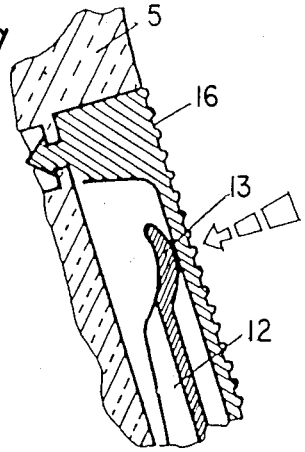
Figure 3:
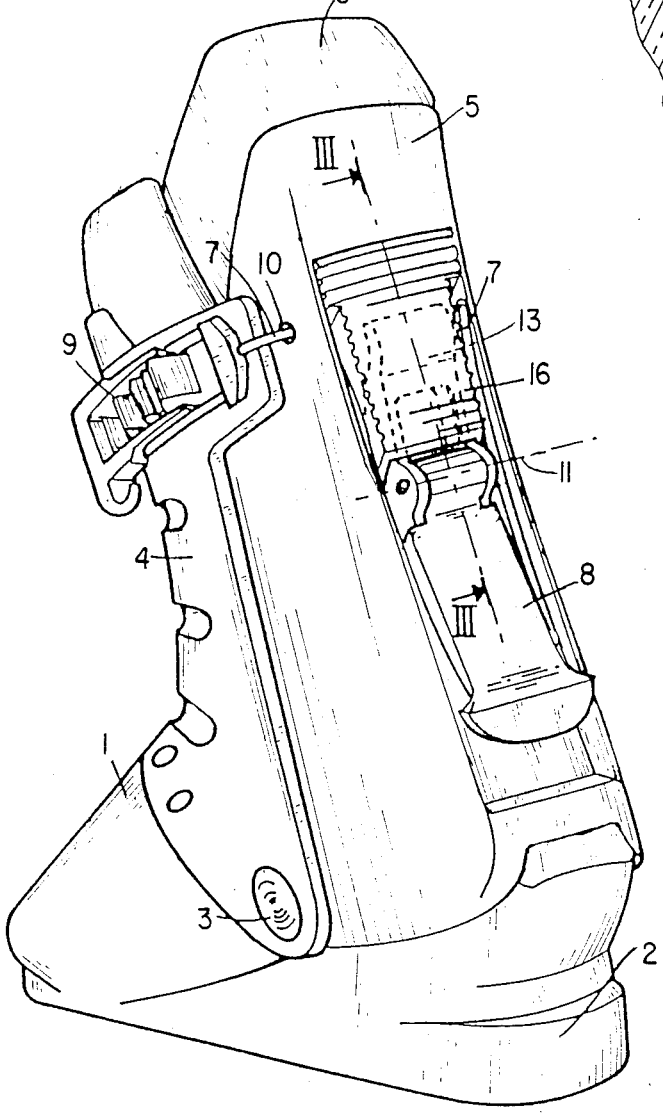

FIGS. 1, 2 and 3 illustrate a rear entry ski boot which in a conventional manner comprises a rigid shell base 1 which is formed of a single piece with sole 2. An upper constituted by a cuff 4 and a rear spoiler 5 is journalled around a transverse axis 3 which is at least approximately horizontal on shell base 1. The boot preferably includes an interior slipper 6 made of a foam material.

The closure of the upper on the lower leg of the skier is achieved by the cooperation of cable 7 and a manipulation lever 8. Cable 7 is laterally anchored on both sides of cuff 4, for example, with at least one adjustable hook and pin over-the-center selectively adjustable toggle 9 as is well known, or can be guided on or in cuff 4 by surrounding the front portion of the lower leg of the wearer. Cable 7 then passes through lateral guides 10 of rear spoiler 5 before dropping once again on both sides of the dorsal zone of rear spoiler 5 until being connected by anchoring or by going through the lower end of manipulation lever 8. Lever 8 is journalled at its upper end around a transverse pivot axis or pin 11 on spoiler 5 and is manipulable in the direction of opening (arrow F) against a spring mechanism (not shown). This opening and closing (which may or may not be automatic by virtue of the spring) and latching in closure of the apparatus on cuff 4 is known in itself and need not be further developed.

In FIG. 1, lever 8 has a "U" shape which provides a space between its arms for an adjustment element (unnumbered), for example, which adjusts the hold down in shell base 1, as is known. In FIGS. 2 and 3, on the other hand, lever 8 is shown in solid form, with no cutout.

In the three cases, the boot is shown in the closed and latched position by means of an elbow or toggle formed by guide 10 of cable 6 on rear spoiler 5, the journal axis 11 of lever 8 on rear spoiler 5, and the connection of cable 7 to lever 8, as was previously described.

According to the invention, lever 8 is associated with an unlatching lever 12 which may be journalled on the same axis 11 of rear spoiler 5 as latching or manipulation lever 8. The relative position of the portions which form the bearing on axis 11 of each of levers 8 and 12 is without significance, but the illustration of FIG. 4 corresponds to the case where the journalling of the second lever 12 is between the journal bearings of latching lever 8.

Second lever 12, which is referenced herein as the unlatching lever, is shown in this embodiment in a general fashion as an extension of latching lever 8 on the opposite side of journal 11 and its general direction forms an angle with the second lever such that when the latching lever is in the latched position, second lever 12 or at least its end 13 which can preferably have the general shape of a spatula or spoon, sufficiently projects or is exposed with respect to the contour of rear spoiler 5 such that it can be activated without difficulty by the other leg of the skier. To this end, it will be noted that when the end 13 is in the form of a spatula or spoon, the rounded on convex shape surface of this element faces the exterior of the upper such that the opening impact by a kick of the foot is in all cases assured. Likewise, in FIGS. 4 and 12, end 13 of lever 12 is preferably provided with a rounded portion 13' which makes it possible to obtain an approximately horizontal force component when an opening force is applied by the other foot on the rounded end of the unlatching lever.

Figure 4:
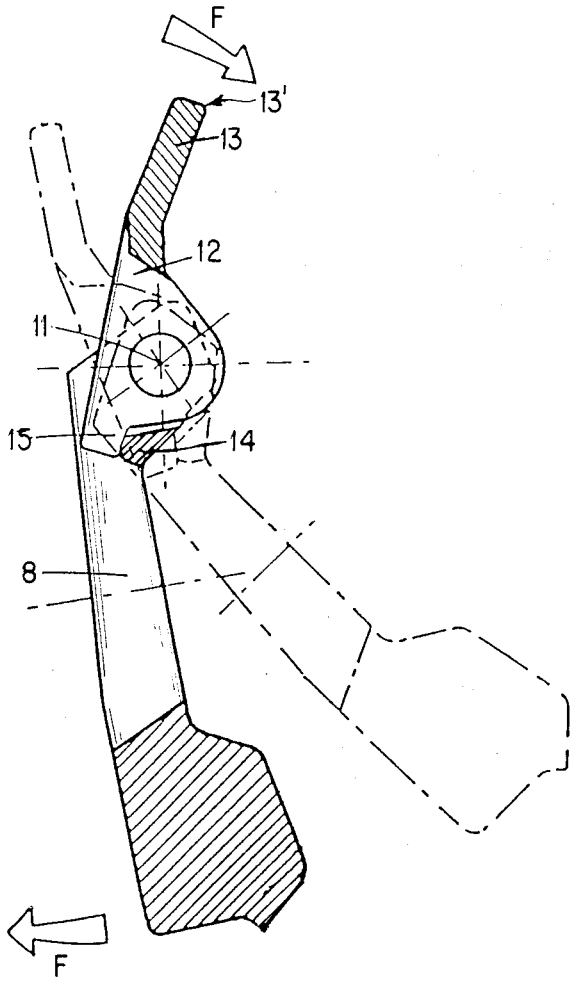
FIG. 4 illustrates in partial cross-section an unlatching lever coupled to the latching lever.

Generally, at the level of journal 11, on rear spoiler 5, the two levers 8 and 12 are coupled to rotate together, at least, in one direction, such that the latching of lever 8 moves unlatching lever 12 towards its projecting or "outlet" position (arrows F in FIG. 4). In the opposite direction, rotation of unlatching lever 12 towards its recessed position causes the unlatching of latching lever 8 (position shown in chain lines in FIG. 4). As shown in FIG. 4, this coupling can be achieved by portions 14 and 15 of each of levers 8 and 12 cooperating in positive abutment, at an appropriate distance from journal axis 11 such that the lever arm between abutments 14 and 15, and axis 11 allows both for latching and unlatching which is sure and easy to obtain without exerting excess force.

Figure 5:
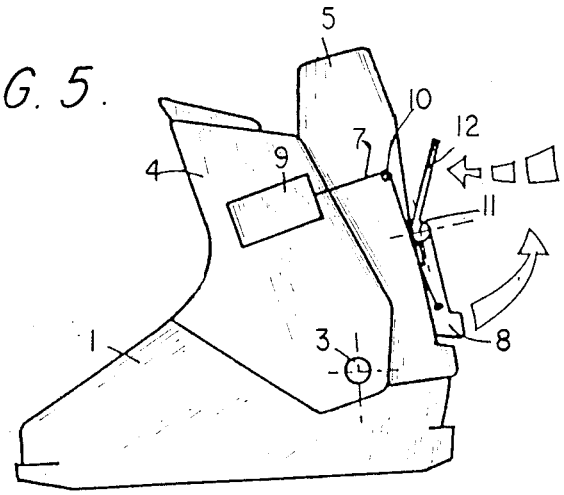
FIGS. 5 and 6 illustrate the extreme phases of operation of the apparatus of FIG. 4 on a boot, and respectively show a boot latched closed, and in the unlatched position for opening of the upper of the boot.
Figure 6:
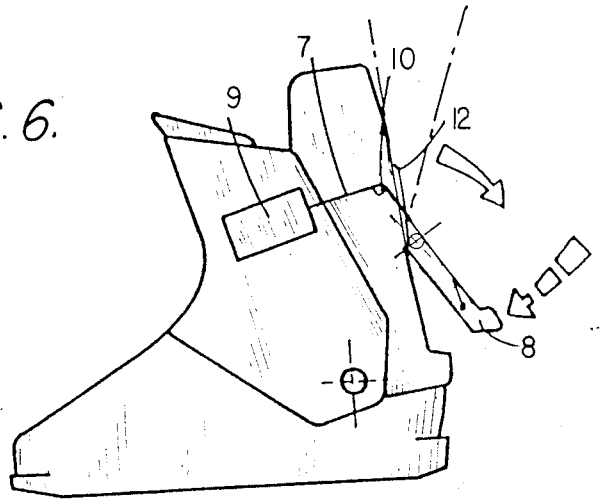

Operation of the system is schematically illustrated in FIGS. 5 and 6. In FIG. 5, the boot is latched and latching lever 12 protrudes outwardly. Pressure, for example exerted by the other foot on lever 12 toward the rear spoiler, (broken arrow) causes the lifting of lever 8 by breaking the toggle or elbow, configuration formed between points 10, 11, and 8 and the unlatching of the boot (solid arrow). The position of FIG. 6 is thus reached where a pressure on lever 8 in the same manner (broken arrow) re-establishes the latching by means of elbow 10, 11, 8 again making unlatching lever 12 protrude.

For esthetic reasons and essentially for reasons of protection, and as shown in FIGS. 3 and 3*a*, unlatching lever 12, above journal 11, can be positioned in a cavity or enclosure of rear spoiler 5 and hidden by a flexible membrane 16. In this arrangement, end 13 of the lever does not "extend out" or protrude in the strict sense, although this term can however be utilized by analogy with what has preceded. Unlatching occurs by pressure on the surface of flexible membrane 16 (broken arrow in FIG. 3*a*), which biases end 13 of unlatching lever 12, such that pressure on membrane 16 acts more reliably, and slipping is prevented. The membrane is preferably channelled in the horizontal direction.

Figure 7:
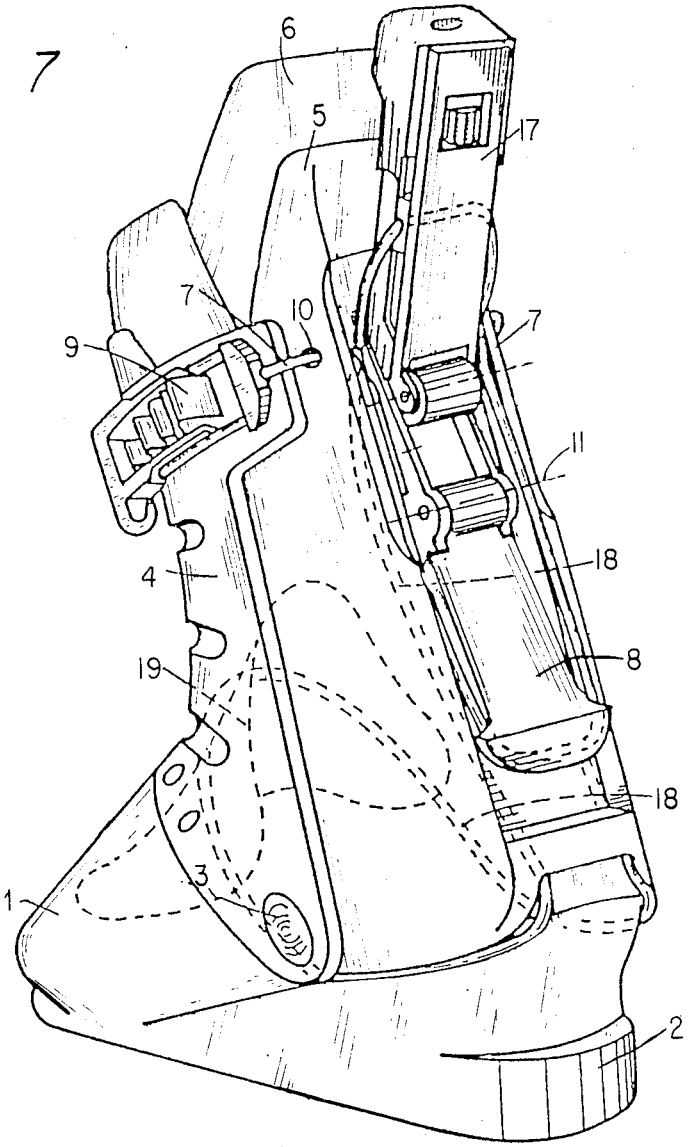
FIG. 7 illustrates a boot to which the invention may be applied, but which furthermore comprises a separate second (foot hold down) lever which is latchable for holding down the foot in the shell base.

FIG. 7 illustrates a boot having substantially the same characteristics as in the previous embodiment but which, in addition, includes above latching lever 8, a separate lever 17 to activate an internal hold down mechanism of the foot in the shell. Hold down lever 17 is journalled on rear spoiler 5, on or preferably above axis 11, as shown, also in an elbow, and controls in a manner which is in itself known, by means of a cable 18, the pressure on the instep of the skier by a foot hold down 19. In particular, as shown, latching lever 8 is latched and foot hold down lever 17 is lifted, thus out of action, and hides the upper end of unlatching lever 12.

Figure 8:
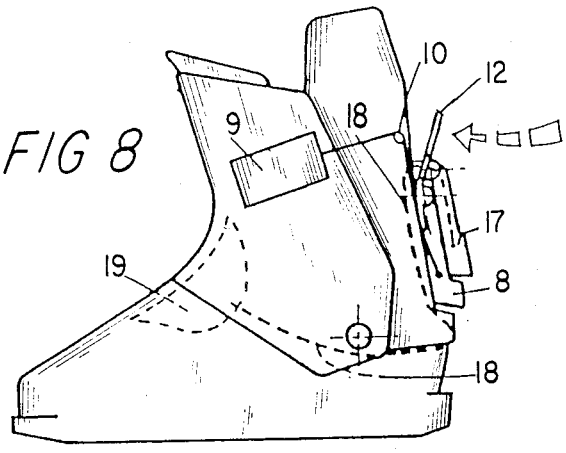
FIGS. 8, 9 and 10 schematically illustrate, for the same type of boot, the operation of the apparatus, FIG. 8 illustrating unlatching, FIG. 9 the opening of the upper and the loosening of the boot, and FIG. 10 the latching of the latching lever and the simultaneous hold down of the foot by means of force exerted on a single lever.
Figure 9:
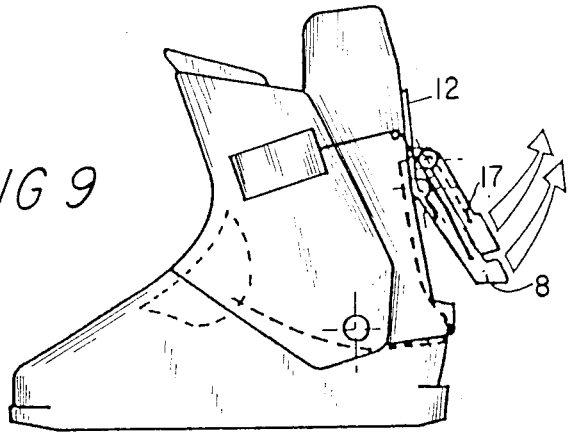
Figure 10:
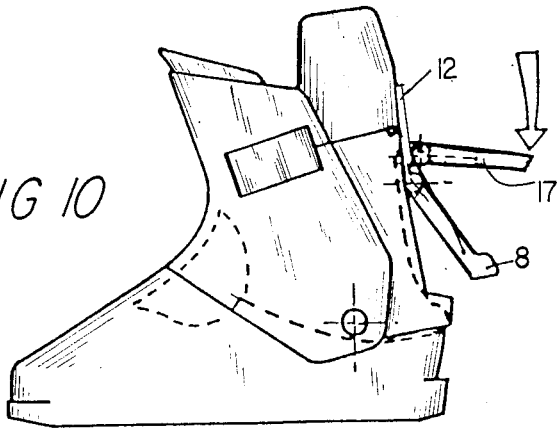

The operation of this assembly is more or less similar to the preceding embodiment and is illustrated in FIGS. 8, 9 and 10. In FIG. 8, latching lever 8 and foot hold down lever 17 are latched and unlatching lever 12 protrudes. Pressure exerted on lever 12 (broken arrow) causes simultaneous unlatching of levers 8 and 17, the latching lever 8 pushing hold down lever 17 upwardly together with it, as shown by the arrows in FIG. 9. When the boot has just been put on and, before latching, it is in the position illustrated in FIG. 10. Action on hold down lever 17 in the direction of the broken arrow, for example by the other foot, causes the hold down of the foot and the latching of the two levers 17 and 8, the first causing the second to rotate.

Figure 11:
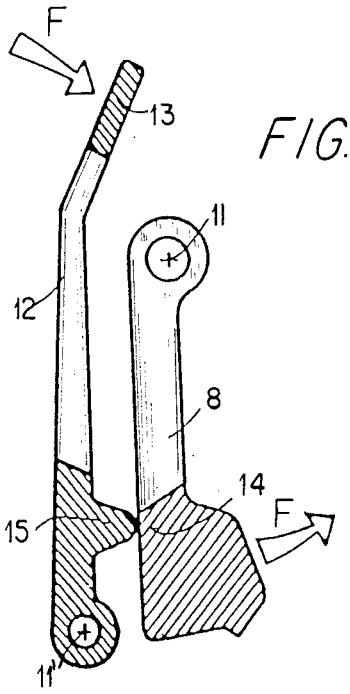
FIGS. 11 and 12 show two alternative embodiments of the apparatus of FIG. 4.
Figure 12:
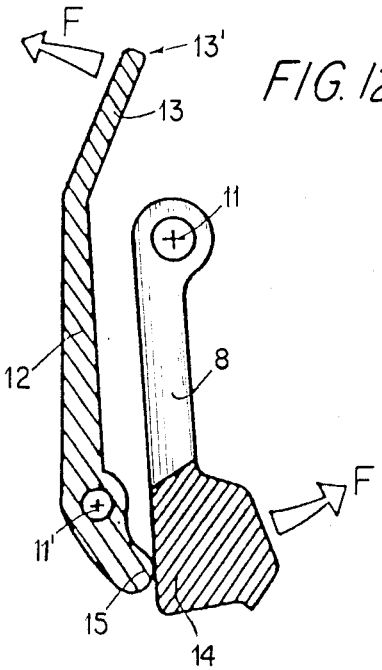

In what has preceded, latching lever 8 and the unlatching lever 12 has been shown common journal axis 11 on rear spoiler 5. This arrangement, although it appears preferable, is however not necessary. As illustrated in FIGS. 11 and 12, unlatching lever 12 can have a journal axis 11'on rear spoiler 5, which is distinct from axis 11 and situated at a level below it, as shown, or at a higher level. The force to be exerted for unlatching will occur in one direction or the other as indicated by arrows F depending upon whether abutment 15 of unlatching lever 12 cooperates with abutment 14 of latching lever 8, on the same or the opposite side of leer end 13, with respect to axis 11'.

From the description which has preceded, it is seen that in all cases where a rear entry boot can be latched by a closure latch for closing the cuff on the lower leg of the skier, the unlatching lever makes it possible by simple intervention of the other foot, without the skier having to bend down, to break the toggle which assures latching. This is even the case wher the latching lever is associated with a second lever which activates an internal foot hold down apparatus.

Although the invention has been described with reference to particular means, materials and embodiments, it is to be understood that the invention is not limited to the particulars disclosed, and extends to all equivalence within the scope of the claims. For example, although the invention has been described with respect to a particular type of hold-down mechanism, and cable system, it is to be understood that the invention is not limited to those particulars and that the concept of the invention can be applied to such systems generally.

What is claimed is:

1. Latching apparatus and unlatching means for use with a ski boot on a ski slope, said ski boot comprising a shell base and an upper, said upper being adapted to allow for entry of the foot into said ski boot, said latching apparatus having at least two positions, an open position in which the upper is left open to allow for entry of the foot, and a closed position in which the upper is closed around the lower portion of the leg, said latching apparatus being associated with said unlatching means whereby said unlatching means allows for opening of asid latching apparatus without the skier having to bend down, wherein the skier wears first and second boots, wherein said first boot has said latching apparatus and unlatching means thereon, wherein said unlatching means comprises means for allowing for the opening of said latching apparatus in response to pressure from said second boot on said latching apparatus while the skier maintains his balance on said ski slope.

2. The latching apparatus as defined by claim 1 wherein said unlatching means comprises an unlatching lever associated with said latching apparatus whereby force exerted on said unlatching lever causes said latching apparatus to move to said open position.

3. The latching apparatus as defined by claim 2 wherein said latching apparatus comprises a cable and a latching lever, said latching lever being associated with said cable whereby closure of said latching lever draws said cable to close said upper.

4. The latching apparatus as defined by claims 3 wherein said latching lever has an open position, a dead point ahead of a closed position, and a closed position.

5. The latching apparatus as defined by claim 4 wherein said unlatching lever is adapted to exert a force on said latching lever to move said latching lever from said closed position and past said dead point towards said open position.

6. The latching apparatus as defined by claim 5 wherein the tension of said cable when said latching lever is in the closed position is sufficient to open said latching lever after it is moved through its dead point by said unlatching lever.

7. The latching apparatus as defined by claim 4 wherein said latching lever serves as an over-the-center toggle, and wherein said unlatching lever is positioned to break said toggle to the open position upon the application of pressure onto said unlatching lever.

8. The latching apparatus as defined by claim 1 wherein said upper comprises a cuff and a rear spoiler allowing for rear entry of the foot.

9. The latching apparatus as defined by claim 8 wherein said ski boot further comprises a foot hold down for exerting pressure on the instep of said foot.

10. The latching apparatus as defined by claim 9 wherein said foot hold down is regulated by means of a second cable, said second cable being distinct from or the same as said first cable.

11. The latching apparatus as defined by claim 10 wherein said second cable is operated by means of a hold down lever.

12. The latching apparatus as defined by claim 11 wherein said hold down lever is an over the center toggle having open, closed and dead point positions.

13. The latching apparatus as defined by claim 12 wherein said hold down lever and said latching lever are positioned to pivot in the same general direction upon application of force to said unlatching lever.

14. The latching apparatus as defined by claim 1 wherein said latching apparatus comprises a latching lever in the form of an over the center toggle having open, closed and dead point positions, to be pivotably mounted around an axis on said ski boot.

15. The latching apparatus as defined by claim 14 wherein said unlatching means comprises an unlatching lever to be pivotably mounted on said booth to pivot around an axis common with the pivot axis of said latching lever.

16. The latching apparatus as defined by claim 15 wherein said unlatching lever acts as a mechanical lever having its longer lever arm exposed in a manner so that it can be kicked by the skier's other boot, thereby exerting a force on said latching lever to move said latching lever from said closed position past said dead point towards said open position.

17. The latching apparatus as defined by claim 15 wherein said unlatching lever is pivotably mounted on said boot along a pivot axis different from the pivot axis of said latching lever.

18. The latching apparatus as defined by claim 17 wherein said unlatching lever acts as a mechanical lever having longer and shorter lever arms, the longer lever arm being exposed in a manner so as to be kicked by the skier's other boot, thereby exerting a force through the shorter lever arm on said latching lever to move said latching lever past said dead point towards said open position.

19. The latching apparatus as defined by claim 17 wherein said unlatching lever is mounted between said latching lever and said booth whereby force exerted on said unlatching lever pushes said latching lever to pivot away from said boot towards said open position.

20. The latching apparatus as defined by claim 19 wherein said unlatching lever has an upper exposed portion, and an intermediate portion positioned to exert a force on said latching lever as said unlatching lever pivots.

21. The latching apparatus as defined by claim 2 wherein said unlatching lever is within an enclosure covered by a flexible membrane whereby said unlatching lever is effectively exposed to a force being exerted thereon through said membrane, but is protected from the elements nevertheless.

22. The latching apparatus as defined by claim 3 wherein said latching lever has a "U" configuration.

23. The latching apparatus as defined by claim 1 mounted on said ski boot.

24. A ski boot having an upper and a shell base, said upper being formed of a cuff and rear spoiler which close about the lower leg of a skier, and a latching apparatus for latching said cuff and rear spoiler together, said latching apparatus having at least two positions, an open position in which the upper is left open to allow for entry of the foot, and a closed position in which the upper is closed around the lower portion of the leg, said latching apparatus being associated with unlatching means allowing for opening of said latching apparatus without the skier having to bend down, wherein the skier wears first and second boots, wherein said first boot has said latching apparatus and unlatching means thereon, wherein said unlatching means comprises means for allowing for the opening of said latching apparatus in response to pressure from said second boot on said latching apparatus without the skier losing his balance on said ski slope.

25. The ski boot as defined by claim 24 wherein said unlatching means comprises an unlatching lever associated with said latching apparatus whereby force exerted on said unlatching lever causes said latching apparatus to move to said open position.

26. The ski boot as defined by claim 25 wherein said latching apparatus comprises a cable and a latching lever, said latching lever being associated with said cable whereby closure of said latching lever draws said cable to close said upper.

27. The ski boot as defined by claim 26 wherein said latching lever has an open position, a dead point ahead of a closed position, and a closed position.

28. The ski boot as defined by claim 27 wherein asid unlatching lever is adapted to exert a force on said latching lever to move said latching lever from said closed position and past said dead point towards said open position.

29. The ski boot as defined by claim 28 further comprising a foot hold down for exerting pressure on the instep of said foot.

30. The ski boot as defined by claim 29 wherein said foot hold down is regulated by means of a second cable, said second cable being distinct from or the same as said first cable.

31. The ski boot as defined by claim 30 wherein said second cable is operated by means of a hold down lever.

32. The ski boot as defined by claim 31 wherein said hold down lever is an over the center toggle having open, closed and dead point positions.

33. The ski boot as defined by claim 32 wherein said hold down lever and said latching lever are positioned to pivot in the same general direction upon application of force to said unlatching lever.

34. The ski boot as defined by claim 33 wherein said unlatching lever has an upper exposed portion, and an intermediate portion positioned to exert a force on said latching lever as said unlatching lever pivots.

35. The ski boot as defined by claim 24 wherein said unlatching lever is protected by a rubber enclosure whereby said unlatching lever is effectively exposed to a force being exerted thereon through said rubber enclosure, but is protected from the elements nevertheless.

36. Latching apparatus for closing a rear entry ski boot, said ski boot having an upper composed of: a shell base, a cuff and a rear spoiler, at least said rear spoiler being journalled around a transverse axis on said shell base, and a cable guided on the rear spoiler and connected to the lower end of a latching lever journalled at its upper portion around a transverse axis on the rear spoiler, said latching lever being associated with an unlatching lever in a manner whereby a force exerted on said latching lever allows for the opening of said latching lever and whereby said unlatching lever allows for the opening of said latching lever without the skier having to bend down, wherein the skier wears first and second boots, wherein said first boot has a latching apparatus and unlatching means thereon, wherein said unlatching means comprises means for allowing for the opening of said latching apparatus in response to a pressure from said second boot on said latching apparatus without the skier losing his balance on said ski slope.

37. The latching apparatus as defined by claim 36 wherein said cable is anchored on each side of the cuff.

38. The latching apparatus as defined by claim 36 wherein said cable is guided on the rear spoiler and connected to the lower end of said latching lever whereby an over the center toggle is formed by said cable and said latch, and wherein said unlatching lever is operable to move said toggle to the open position.

39. The latching apparatus as defined by claim 38 wherein the unlatching lever is journalled to pivot around a transverse pivot axis on said rear spoiler.

40. The latching apparatus as defined by claim 39 wherein the transverse pivot axis of said unlatching lever is distinct from the pivot axis of said latching lever.

41. The latching apparatus as defined by claim 40 wherein the transverse pivot axis of the unlatching lever is below the pivot axis of the latching lever.

42. The latching apparatus as defined by claim 41 wherein the transverse pivot axis of the unlatching lever is above the journal axis of the latching lever.

43. The latching apparatus as defined by claim 36 wherein closure of said latching lever exposes said unlatching lever.

44. The latching apparatus as defined by claim 43 whereby a free end of said unlatching lever is exposed upon closure of said latching lever such that said unlatching lever may be activated by the other foot of the skier.

45. The latching apparatus as defined by claim 44 whereby said free end is convex towards the exterior.

46. The latching apparatus as defined by claim 36 wherein said unlatching lever is located within an enclosure of said rear spoiler.

47. The latching apparatus as defined by claim 46 wherein said enclosure is covered by a flexible membrane.

48. The latching apparatus as defined by claim 47 wherein said membrane has a channelled surface.

49. The latching apparatus as defined by claim 36 further comprising a foot hold down lever for activating a foot hold down within said shell base.

50. The latching apparatus as defined by claim 49 wherein said foot hold down lever is an over the center toggle pivotably journalled above said unlatching lever.

51. Latching apparatus for closing a rear entry ski boot, said ski boot having an upper composed of: a shell base, a cuff and a rear spoiler, at least said rear spoiler being journalled around a transverse axis on said shell base, and a cable guided on the rear spoiler and connected to the lower end of a latching lever journalled at its upper portion around a transverse axis on the rear spoiler, said latching lever being associated with an unlatching lever in a manner whereby a force exerted on said unlatching lever allows for the opening of said latching lever, wherein said latching apparatus further comprises a foot hold down lever for activating a foot hold down within said shell base, wherein said foot hold down lever is an over the center toggle pivotably journalled above said unlatching lever, wherein closure of said foot hold down lever simultaneously causes closure of said latching lever.

52. The latching apparatus as defined by claim 51 wherein unlatching of said latching lever by said unlatching lever simultaneously causes unlatching of said foot hold down lever.

* * * * *

UNITED STATES PATENT AND TRADEMARK OFFICE

CERTIFICATE OF CORRECTION

PATENT NO. : 4,672,755

DATED : June 16, 1987

INVENTOR(S) : Louis BENOIT et al.

It is certified that error appears in the above-identified patent and that said Letters Patent is hereby corrected as shown below:

At column 1, line 35, delete "which".

At column 4, line 54, change "on" to ---or---.

At column 5, line 61, insert ---on a--- after "shown".

At column 6, line 3, change "leer" to ---lever ---.

At column 6, line 11, change "wher" to ---when ---.

At column 6, line 35, change "asid" to ---said ---.

At column 7, line 55, change "booth" to --- boot---.

At column 8, line 36, change "asid" to ---said ---.

At column 9, line 7, change "latching" to ---unlatching---.

Signed and Sealed this

Eleventh Day of October, 1988

*Attest:*

DONALD J. QUIGG

*Attesting Officer*

*Commissioner of Patents and Trademarks*